United States Patent [19]

Zuppiger

[11] 4,078,500

[45] Mar. 14, 1978

[54] VEHICLE DRIVE SYSTEM IN WHICH A PLURALITY OF VEHICLES ARE MOVED AT VARIABLE SPEEDS BY MEANS OF A CONSTANT-SPEED DRIVE

[75] Inventor: Paul Zuppiger, Athenaz-Geneva, Switzerland

[73] Assignee: Battelle Memorial Institute, Geneva, Switzerland

[21] Appl. No.: 660,508

[22] Filed: Feb. 23, 1976

[30] Foreign Application Priority Data

Feb. 21, 1975 Switzerland ..... 2216/75

[51] Int. Cl.[2] ..... B61B 10/00; B61B 12/10

[52] U.S. Cl. ..... 104/173 R; 104/229

[58] Field of Search ..... 104/18, 20, 25, 28, 104/30, 31, 211, 173, 174, 178, 180, 200, 202, 204, 205, 207, 209, 212, 214, 216, 222, 229, 231, 240; 198/334, 321

[56] References Cited

U.S. PATENT DOCUMENTS

| | | | |
|---|---|---|---|
| 350,078 | 9/1886 | Pendleton | 104/231 |
| 496,188 | 4/1893 | Cook | 104/229 |
| 3,485,182 | 12/1969 | Crowder et al. | 104/18 |
| 3,601,246 | 8/1971 | DuBois | 198/334 |

*Primary Examiner*—Lawrence J. Oresky
*Assistant Examiner*—Carl Rowold
*Attorney, Agent, or Firm*—Karl F. Ross

[57] ABSTRACT

A vehicle system has a track along which a cable is driven, preferably at constant speed, to entrain a plurality of vehicles rollingly along the track. The vehicle carries a pair of pinch rollers adapted to grip the cable without slippage and at least one of these rollers is journaled on the vehicle and can entrain a star-shaped member whose spokes or arms have rollers adapted to engage cam surfaces disposed along the track. Depending upon the orientation of the cam surfaces, the vehicle may be displaced at a rate in excess of the linear speed of the cable, at the same rate as the cable or at a slower speed. This allows the vehicle to be slowed down for embarkation and disembarkation but permits the vehicle to be driven at high speeds between such embarkation/-disembarkation stations all while the cable is operated at substantially constant speed.

8 Claims, 7 Drawing Figures

VEHICLE DRIVE SYSTEM IN WHICH A PLURALITY OF VEHICLES ARE MOVED AT VARIABLE SPEEDS BY MEANS OF A CONSTANT-SPEED DRIVE

FIELD OF THE INVENTION

My present invention relates to a vehicle system for the transportation of people or goods and, more particularly, to a vehicle system having a fixed track upon which a plurality of vehicles can be displaced in closely spaced relationship, preferably as a personnel carrier.

BACKGROUND OF THE INVENTION

The interest in vehicle systems for the transportation of people and things, e.g. goods, along a track has gained importance with the development of urban facilities, shopping centers, transportation centers and the like. It is not uncommon for a shopping center or a transportation facility to be provided with a track system along which a plurality of vehicles, e.g. simple platforms or more complex cars, are displaced between embarkation and disembarkation stations through high-speed regions. Such vehicle systems have been provided between urban centers, between urban centers and suburban parking facilities and even within industrial installations such as a plant where goods or people are to be moved from one place to another.

Such systems generally comprise a multiplicity of vehicles which must be displaced at variable speed, i.e. at a low or zero speed through an embarkation or disembarkation station, and at a relatively high speed between stations.

Several different solutions have been proposed for the operation of such vehicle systems at variable speed. It has been suggested, for example, to pass the vehicle through fixed locations along a road bed or track at which a speed impulse is imparted to the vehicle. This is the case with linear motors or friction drive wheels.

There are also systems in which the vehicle is entrained in stages. In most of these entrainment systems, it is necessary to provide distinct drive devices for the high-speed sector and for the low-speed embarkation and disembarkation sectors, and even a separate drive for the vehicle-recycling sector. The drives at the embarkation/disembarkation sectors and the recycling sector, of course, operate at lower speed than the drive controlling displacement between embarkation and disembarkation sectors.

The passage of a vehicle from one such sector to another or from one drive system to another poses problems with respect to synchronization which has been found to be a highly delicate matter especially since the vehicles must generally be displaced in a relatively tight or closely adjacent formation for reasons of safety.

Systems in which the entire drive is brought to a standstill for each immobilization of the vehicle are disadvantageous because of the inertial problems of starting and stopping, as well as the problem of timing the stopping so that vehicles are not halted when they should be in a high-speed operating mode.

Systems in which a common drive is provided for all of the vehicles which are individually released and recoupled to the drive at the embarkation/disembarkation stations also are not fully satisfactory because the vehicles cannot be maintained in a fixed relationship in such systems and frequently problems are encountered with respect to recoupling of the vehicle to or decoupling it from the drive.

OBJECTS OF THE INVENTION

It is the principal object of the present invention, therefore, to provide an improved vehicular transport system whereby the aforementioned disadvantages are obviated.

Another object of my invention is to provide an improved vehicle system (capable of operating more efficiently and safely than the prior-art systems.

Still another object of the invention is to provide an improved track and vehicle installation for the transportation of people or things.

SUMMARY OF THE INVENTION

These objects and others which will become apparent hereinafter are attained, in accordance with the invention, with vehicles propelled along a track wherein a drive member is displaced along the track at a substantially constant speed. Each vehicle is coupled to the track with a wheel engaged by the drive element and rotatable on the vehicle but incapable of slipping relative to the drive element. The wheel is angularly constrained against rotation relative to the vehicle structure by engagement of a cam follower angularly entrained by the wheel with cam surfaces disposed along and fixed relative to the track whereby the displacement of the vehicle is a function of the movement of the axis of the wheel along the track brought about by the constrained rotation of the wheel relative to the axis.

Advantageously the wheel is coupled with a plurality of cam followers which engage successive cam surfaces along the track and the cam surfaces along the track are so oriented and disposed as to provide low-speed displacement of the vehicle at certain locations corresponding to embarkation and disembarkation stations, high speeds of the vehicle intermediate these stations and like variations in the speed of the vehicle in spite of the constant speed drive of the element which engages the wheel.

Preferably this element is pinched against the wheel by a pinch roller so that there is no slip between the drive element and the periphery of the aforementioned wheel.

More specifically the invention comprises entraining a vehicle along a rolling track on which the vehicle is guided with the aid of a cable displaced along the track. The cable is engageable with the rim of the wheel journaled on the vehicle and, in order to control the speed at which the vehicle is displaced along the track, the angular velocity of the wheel is controlled by cam surfaces along the track.

The invention thus comprises a vehicle system for the transportation of people or things, including a track provided with rails or support surfaces rollingly engageable by the vehicle and further formed with means for guiding the vehicle along the track, preferably along a closed path.

The vehicles which are displaceable along this track are provided with rolling means engageable with the aforementioned rails to enable the vehicle to move with low friction around the track. A cable is guided along the track over at least the major part of the length thereof and means is provided for driving the cable longitudinally at a predetermined speed.

Each vehicle is provided with the aforementioned wheel which is engageable at its rim with the cable and cooperates with a pinch roller which is displaceable toward and away from the wheel rim so as to grip the cable between the rim of the wheel and the surface of the pinch roller without slipping of the wheel rim relative to the cable. The wheel and the pinch roller of each vehicle are journaled thereon about axes lying in a plane perpendicular to the plane of the axes of the rolling means whereby the vehicle is supported and guided on the track.

Means, e.g. a lever arrangement or other actuating mechanism, is provided to press the pinch roller and the wheel laterally against the cable, i.e. toward one another to kinetically couple the periphery of the wheel fixedly (without slippage) with the periphery of the cable.

The means for constraining the angular rotation of each vehicle wheel comprises a star structure having radial arms and being rotatable about the axis of the wheel preferably such that the axis of the star element forms an angle with that of the wheel so that the trajectory of the radial arms is inclined to the plane of the wheel. Means is provided for angularly coupling the star with the wheel so that they are rotatably entrained fixedly with one another and incapable of slipping, each relative to the other.

Along the track there are provided fixed cams each of which has an entry and exit at which the cam follower rollers of successive arms of the star can pass into engagement and out of engagement with the cam respectively, the cams being positioned for successive engagement by the arms as the latter reach the low point in their inclined trajectory.

The cams are so shaped that the lines joining their entry and exit in the region of acceleration of the vehicle are inclined toward the cable in the direction of vehicle displacement, are inclined away from the cable in the direction of vehicle displacement in regions in which the vehicle is to be slowed down, and are parallel to the cable in regions in which the vehicle is to be operated at the same speed as the cable.

The cams can also be oriented so that the vehicle speed is minimal at certain locations along the track whereby people can embark or disembark, goods can be loaded or unloaded, etc. When the cams are oriented generally transversely of the track and of the cable, minimum speed is generated. When the cam is inclined toward the track, the wheel is caused to roll ahead of the cable advance so that the vehicle moves at a speed greater than that of the cable.

According to another feature of the invention, camming rails are provided at selected locations along the track, e.g. a vehicle recirculation bight thereof, to disengage the pinch rollers from the cable and enable the vehicle to be entrained by a chain, independently of cable displacement, from a track stretch corresponding to one direction of movement of the vehicle into a track stretch corresponding to another direction of movement thereof.

It has also been found to be advantageous to provide the rolling and guiding means for the vehicle with a pair of spaced apart rollers whose axes are vertical and which are guided in upwardly open channels running along the track. This maintains the orientation of the vehicles or their platforms so that they do not interfere with one another during the vehicle recirculation phase of the operation. This is especially important since the vehicles are normally displaced in close proximity to one another for safety's sake.

According to another feature of the invention the means coupling the inclined star to the drive wheel of the vehicle is a set of meshing teeth on the wheel and the star, only some of the teeth of which engage because of the inclination of the plane of the star.

The wheel may thus lie in a horizontal plane while the star lies in a plane inclined to the horizontal but has its axis in the same plane as the axis of the wheel. The system has been found to be particularly useful for so-called moving platforms utilized for personnel transport at airport facilities, or for entire moving carriages which can be provided with doors or the like.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
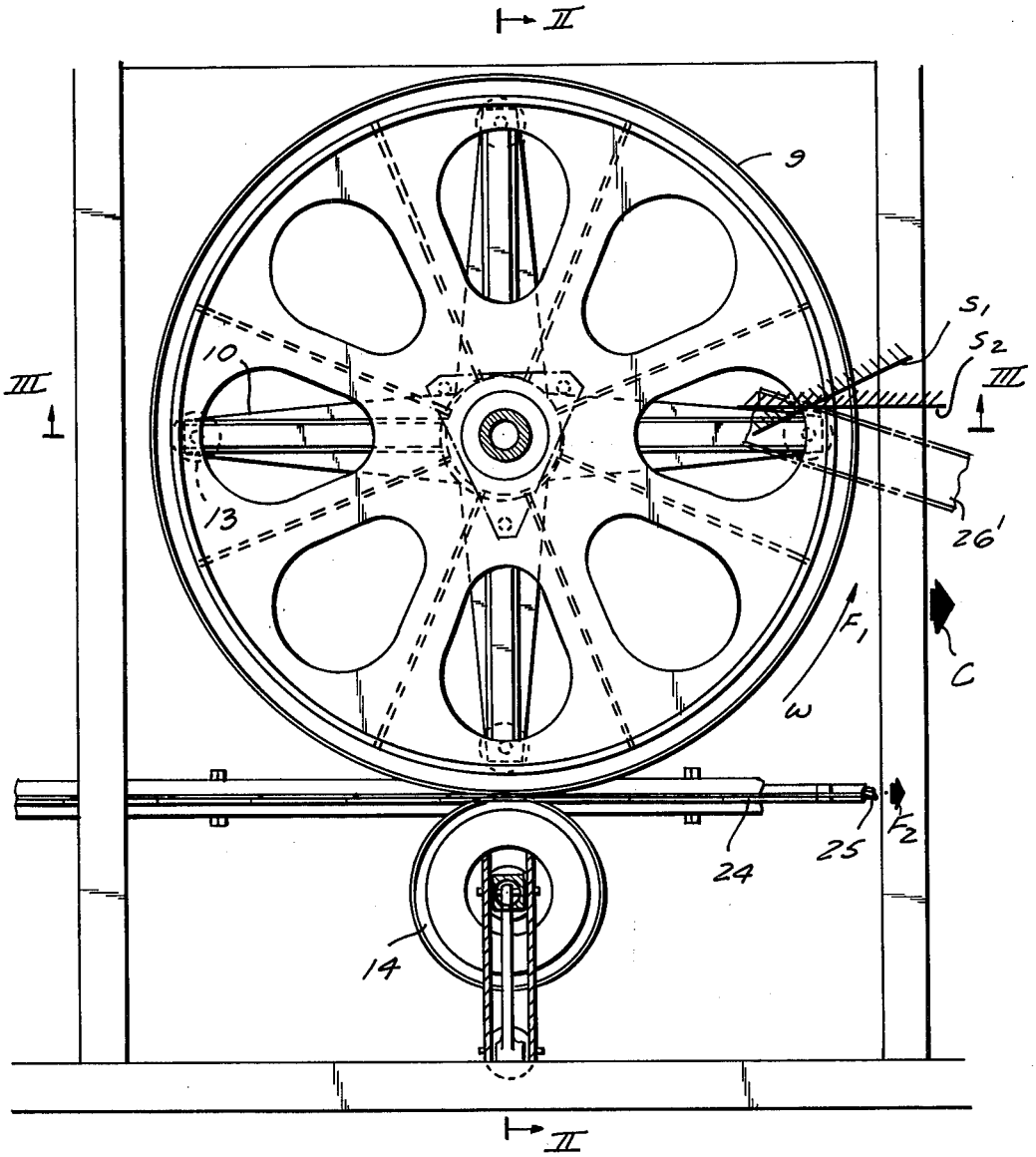
FIG. 1 is a view in cross section along the line I — I of FIG. 2 and illustrating in plan view the pinch roller and wheel of one moving platform, in a position in which a cable is seized between the periphery of the pinch roller and the wheel.
Figure 2:
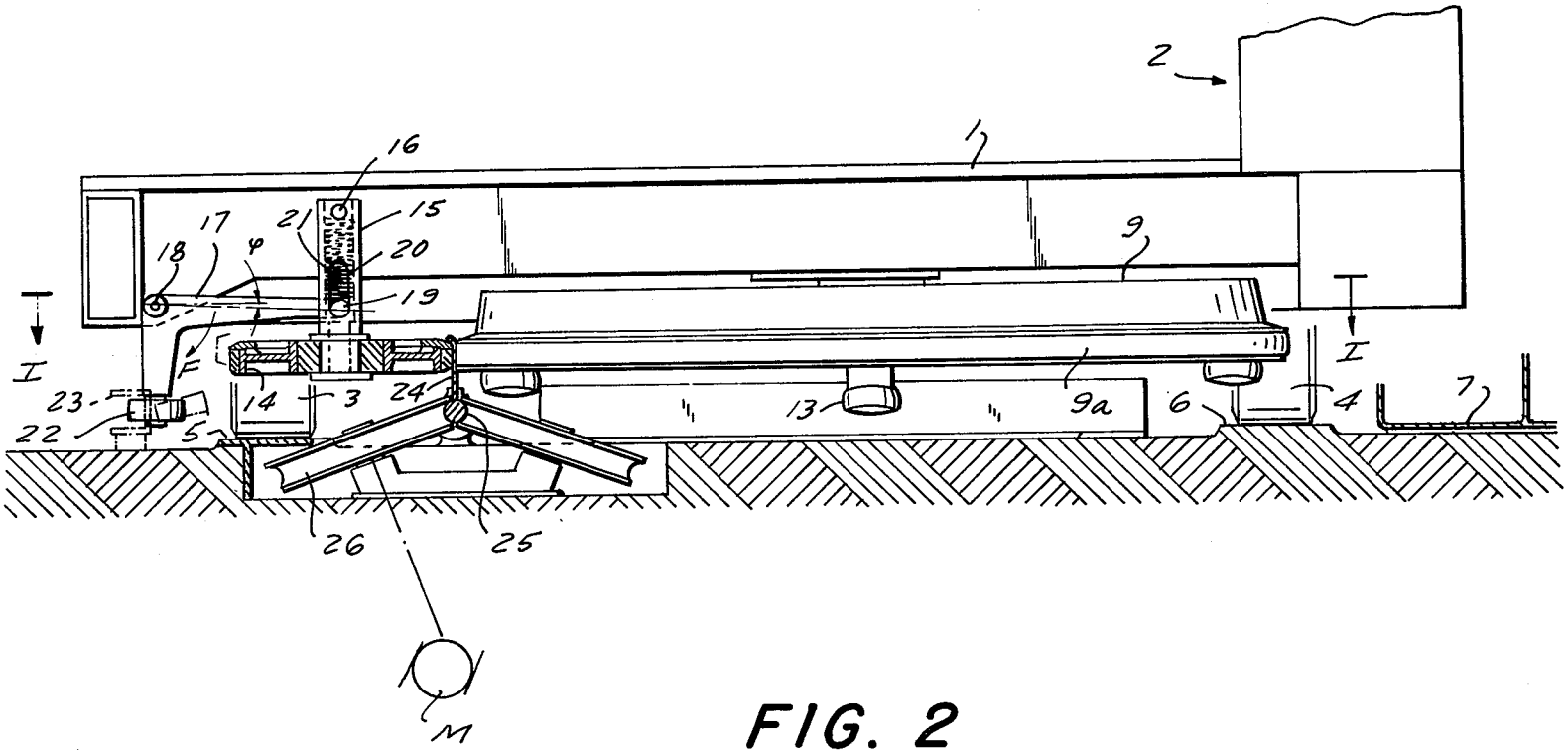
FIG. 2 is a vertical section through the drive portion of a vehicle according to the invention and a corresponding portion of the track, this section corresponding to a view taken along the line II — II of FIG. 1.
Figure 3:
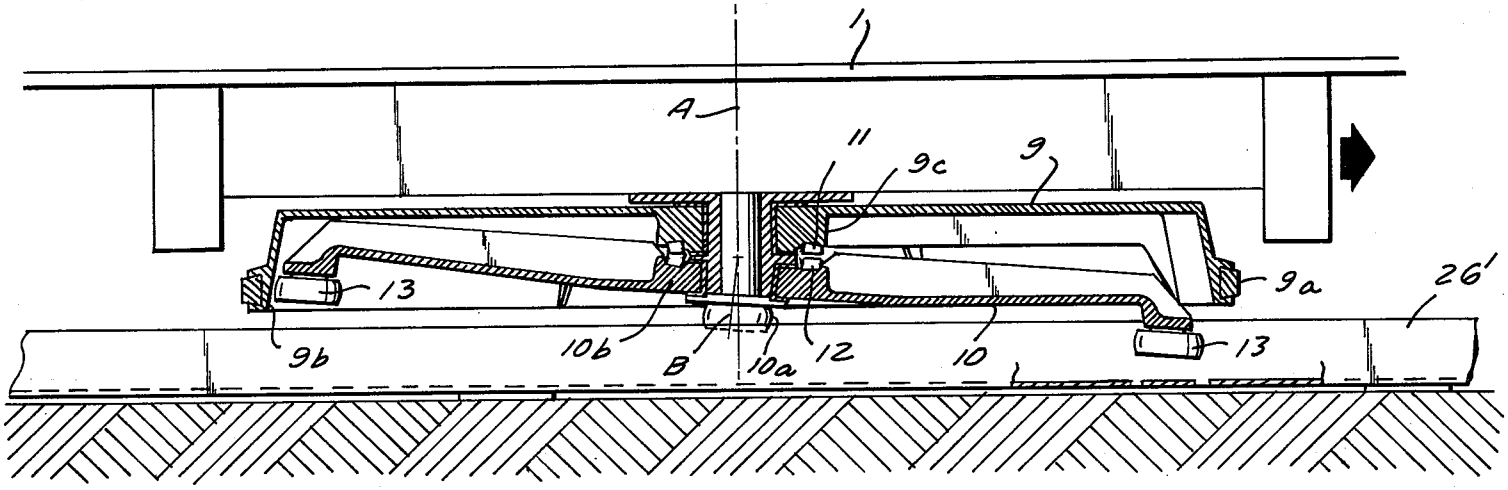
FIG. 3 is a view of a portion of the drive arrangement for a vehicle taken in a plane perpendicular to the plane of FIG. 2 and generally is a cross section taken along the line III — III of FIG. 1.

FIGS. 1 through 3 show the entrainment mechanism for the individual platforms according to the invention.

Figure 4:
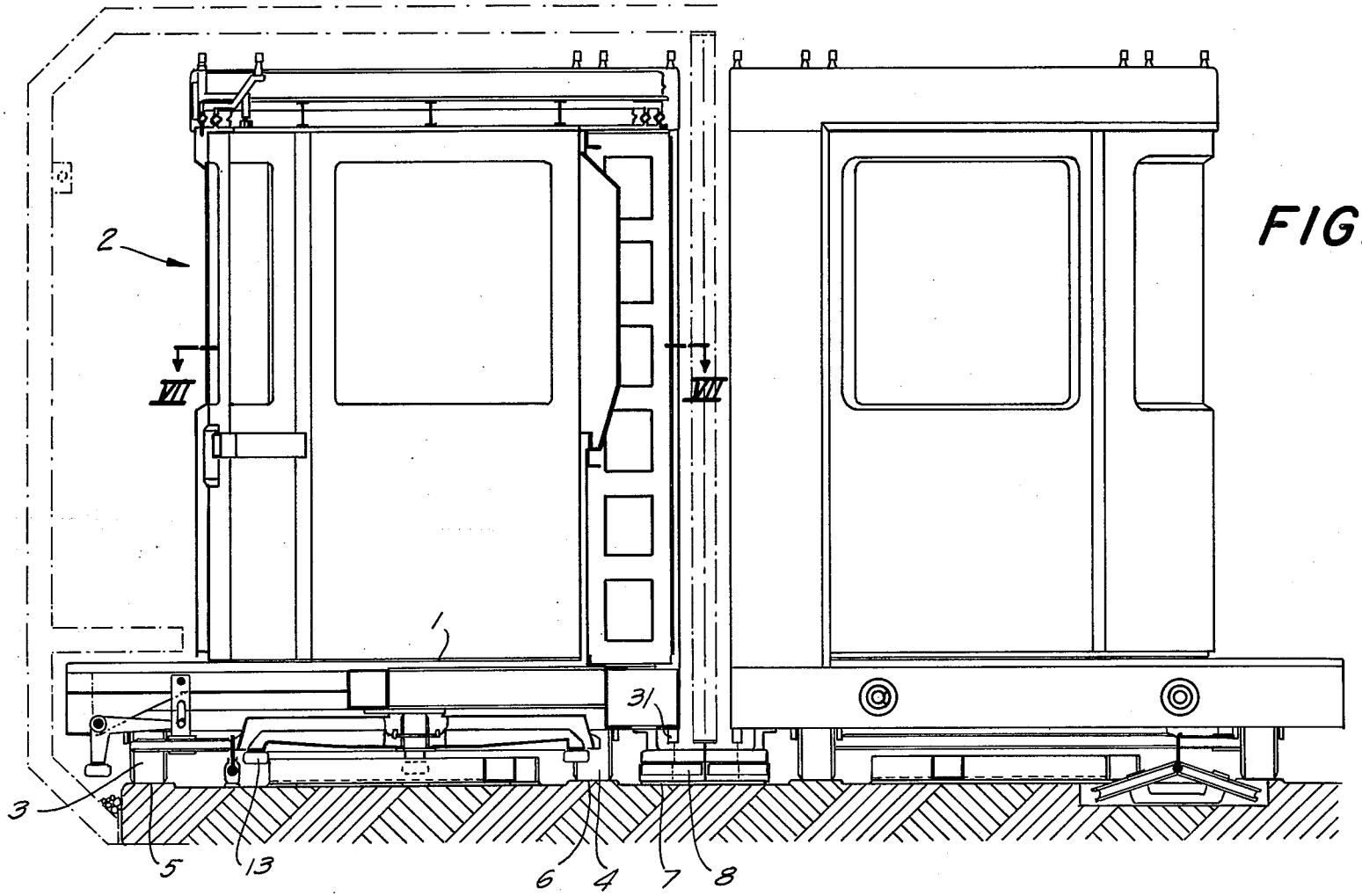
FIG. 4 is an elevational view, partly broken away, of a vehicle system as seen transversely to the track, i.e. generally in the same plane as that in which FIG. 2 was taken, the track being shown at a portion in which the forward and return stretches are located close to one another so that both may be seen simultaneously.

As can be seen in FIG. 2, which is a transverse section through the track showing the vehicle platform 1 of the vehicle 2 shown in greater detail in FIG. 4 (in elevation), the vehicle comprises two pairs of wheels, 3, 4 whose axes are horizontal and which ride upon track members or rails 5 and 6. The vehicle 2 is guided by a U-section or channel-shaped rail 7 which receives a pair of rollers 8 having vertical axes (see FIGS. 4 and 7). The guide rollers 8 are biased slightly in the direction of one of the inner flanks of the channel shaped rail 7 such that each roller bears upon only one of the vertical flanks of the channel.

An entrainment wheel 9 (FIGS. 1 through 3) is rotatably mounted on each platform 1 about a vertical axis A. As is best seen from FIG. 3, the wheel 9 has a bell shape (downwardly open concave configuration) and along its outer rim is formed with an elastic strip **9*a*** of rubber or of synthetic resin material having a high coefficient of sliding friction.

Within the hollow 9b of the wheel 9, there is disposed a mobile body or star having four arms 10 and journaled upon a stem 10a at its hub 10b so as to lie in a plane which is inclined to the plane of the wheel 9, i.e. is inclined to the horizontal. The arms 10 carry at their ends cam-follower rollers 13 which, because of the inclination of the plane of the star, progressively swing toward the lowest position (right hand side of FIG. 3) before ascending again to the uppermost position (left hand side in FIG. 3). The axis B of the star 10 is thus inclined to the axis A of the wheel 9 although these axes lie in a common vertical plane parallel to the plane of the rails 5 and 6. The lowest point reached by the star 10 is located at the side of the vehicle 2 which is forward with respect to the direction of movement.

The wheel 9 is angularly coupled (without slippage) with the star 10 by a pair of crown gears 11 and 12, the former being mounted upon the hub 9c of the wheel 9 while the latter is mounted on the hub 10b of the star.

The cam follower rollers 13 are rotatable on the respective arms, below each extremity thereof, about a respective axis perpendicular to the plane of the star and have functions as will be described below.

A second roller or wheel 14, hereinafter referred to as a pinch roller, is provided for each wheel 9 as shown in FIG. 2.

The pinch roller 14 is mounted rotatably on a bar 15 under the platform 1. The bar 15 is swingably mounted on a pin 16 to the underside of the platform 1 to enable the bar 15 to pivot about a horizontal axis parallel to the rails 5 and 6.

Each bar 15 is actuated by a bell-crank lever 17 fulcrumed at 18 to the underside of platform 1 for swinging movement about axes parallel to axis 16.

One of the arms of the lever 17 (actuating mechanism) is fixed to a slide pin or peg 19 guided in a longitudinal groove 20 formed in the bar 15. The pin 19 likewise perpendicular to the longitudinal axis of the bar. The pin 19 is urged by a spring 21 downwardly against the bottom wall of the longitudinal groove 20. In this position, the pinch roller 14 is pressed against the friction strip 9a of the wheel 9 and forms an angle $\phi$ with a perpendicular drop from the axis 18 to the longitudinal axis of the bar 15. Because of this angle $\phi$, the reaction force exerted by the wheel 9 upon the pinch roller 14 has a tendency to rotate the lever 17 in the clockwise sense represented by the arrow F in FIG. 2. Thus the couple resulting from this reaction force tends to swing the lever downwardly and maintain the bias of the pinch roller 14 in the direction of the periphery of wheel 9.

The other arm of lever 17 carries a cam follower roller 22 adapted to engage a cam 23 which is fixed along the track so that the lever 17 can be swung in the counterclockwise sense opposite arrow F. This displacement of lever 17, shown in dot-dash lines in FIG. 2, swings the bar 15 to the left (FIG. 2) to draw the pinch roller 14 away from the periphery of wheel 9.

As can be seen from FIG. 2, a bar 24 is gripped between the wheel 9 and the pinch roller 14 and is fixed to a track cable 25 displaced by a motor not shown in detail but represented by, for example, the motor M, so that this cable is driven along the track at a substantially constant speed. At spaced locations along the track, the cable passes between groove pulleys 26. To prevent slippage between the face of the strip 24 and the surface of the friction bar 9a of wheel 9 engaged therewith, the friction strip is vertically fluted (striated). It will be demonstrated below that it is of the utmost importance to avoid slippage between this wheel 9 and the cable bar 24.

I have described above the mechanism associated with each vehicle which converts the constant speed of the drive cable into entrainment of the vehicle at speeds in accordance with the position of the vehicle along the track. How the variable speed for each vehicle is obtained will now be considered.

Let us suppose, for a theoretical evaluation of the operation, that the cable 25 is driven by its motor in the direction represented by the arrow $F_2$ (FIG. 1) while the strip 24 is not gripped between wheel 9 and pinch roller 14. In this case the band and cable simply move past the platform and the latter is not driven.

Alternatively if we consider the case in which the band is gripped between the pinch roller 14 and the wheel 9, but the arms 10 are free to rotate together with the wheel 9, there will be no displacement of the vehicle although wheel 9 will be rotated such that its peripheral speed is equal to the linear speed of the strip 24 and the cable 25. The wheel 9 is then driven in the counterclockwise sense (FIG. 1) as represented by the arrow $F_1$ at an angular velocity $\omega$ determined by its peripheral speed. The star wheel with its arms 10 rotates with the angular velocity of wheel 9 because of the mutual engagement of the toothed members 11 and 12 shown in FIG. 3.

However, if the angular displacement of the star wheel 10 is constrained and correspondingly a constraint is placed upon the free angular displacements of wheel 9, there must be a compensatory displacement of the axis of wheel 9 along the track if the cable entrains the periphery of wheel 9 without slippage Thus if a cam surface $S_1$ is put into the path of one of the cam follower rollers 13 (FIG. 1) a constraint is placed upon rotation of the star wheel and hence the rotation of wheel 9.

The surface $S_1$ is shown to be inclined away from the band 24 and the cable 25 in the direction of movement of the vehicle represented by the arrow C. This surface has the effect of reducing the angular velocity $\omega$ of wheel 9 and, of course, of the path roller 14, the latter playing no active role in the entrainment of the vehicle. It is, however, convenient to refer to this roller together with wheel 9 in order to simplify the explanation of the operation. The difference between the angular velocity of wheel 9 when it is not constrained and that of wheel 9 when its rotation is constrained or braked angularly by the surface $S_1$, is transformed (when there is no slip between the cable 25 and wheel 9), into a displacement of the center of wheel 9 in the direction of the arrow $F_2$ and consequently a displacement of the entire vehicle 2 which is fixed with respect to the axis of wheel 9.

If the inclination of the surface is changed, the angular velocity $\omega$ will also be changed. Thus with a surface $S_2$ in the path of the cam follower roller 13, it will be apparent that wheel 9 cannot be displaced angularly and is blocked.

Since the pinch force applied by wheels 9 and 14 to the band 24 and the fluting of the band 24 are dimensioned to prevent any slippage between the vehicle 2 and the cable, the vehicle is entrained in the direction of arrow $F_2$ at the same velocity as the cable 25.

Assume that the constraining surface is now formed by a camming rail 26' which is fixed along the track and is inclined toward the cable 25 in the direction of movement $F_2$ of the vehicle. In this case, the wheel 9 must be induced to roll upon the band 24 in the clockwise sense (FIG. 1) to impart a negative angular velocity to the wheel, i.e. angular velocity opposite that represented by the arrow $F_1$. The wheel 9 is thus rotated in the sense opposite the rotational sense previously described while the cable 25 continues its advance at constant speed. The axis of wheel 9 thus moves in the direction of arrow $F_2$ at a rate greater than the linear velocity of the cable and hence the vehicle 2 has a speed in the direction of the cable displacement which exceeds the cable velocity.

In practice it is not possible to have a vehicle speed which is maintained at twice the cable speed because of the strength of the cable, the power of the motor, the forces applied to the cam followers and the like. This will be clear when it is recognized that the traction upon the cable 25 is proportional to the periphery speed of the wheel 9 rolling on the cable 25 and inversely proportional to the linear speed of this cable. It has been found to be advantageous to provide the cable with a linear speed of about 4.5 m/second and to set the maximum speed of the vehicle at about 7 m/second.

Figure 5:
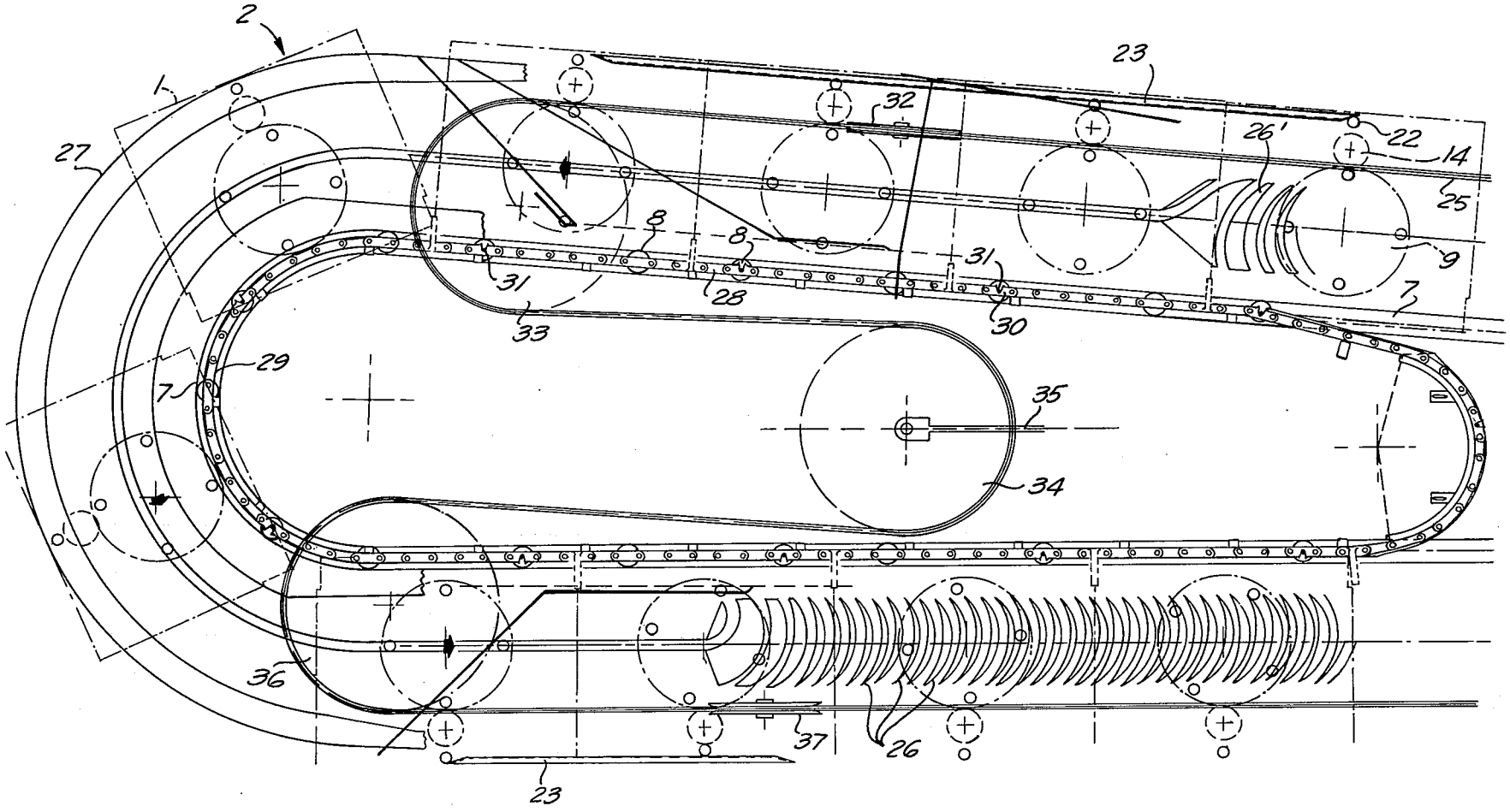
FIG. 5 is a plan view of the vehicle-recirculating end of the track, partially in diagrammatic form.
Figure 6:
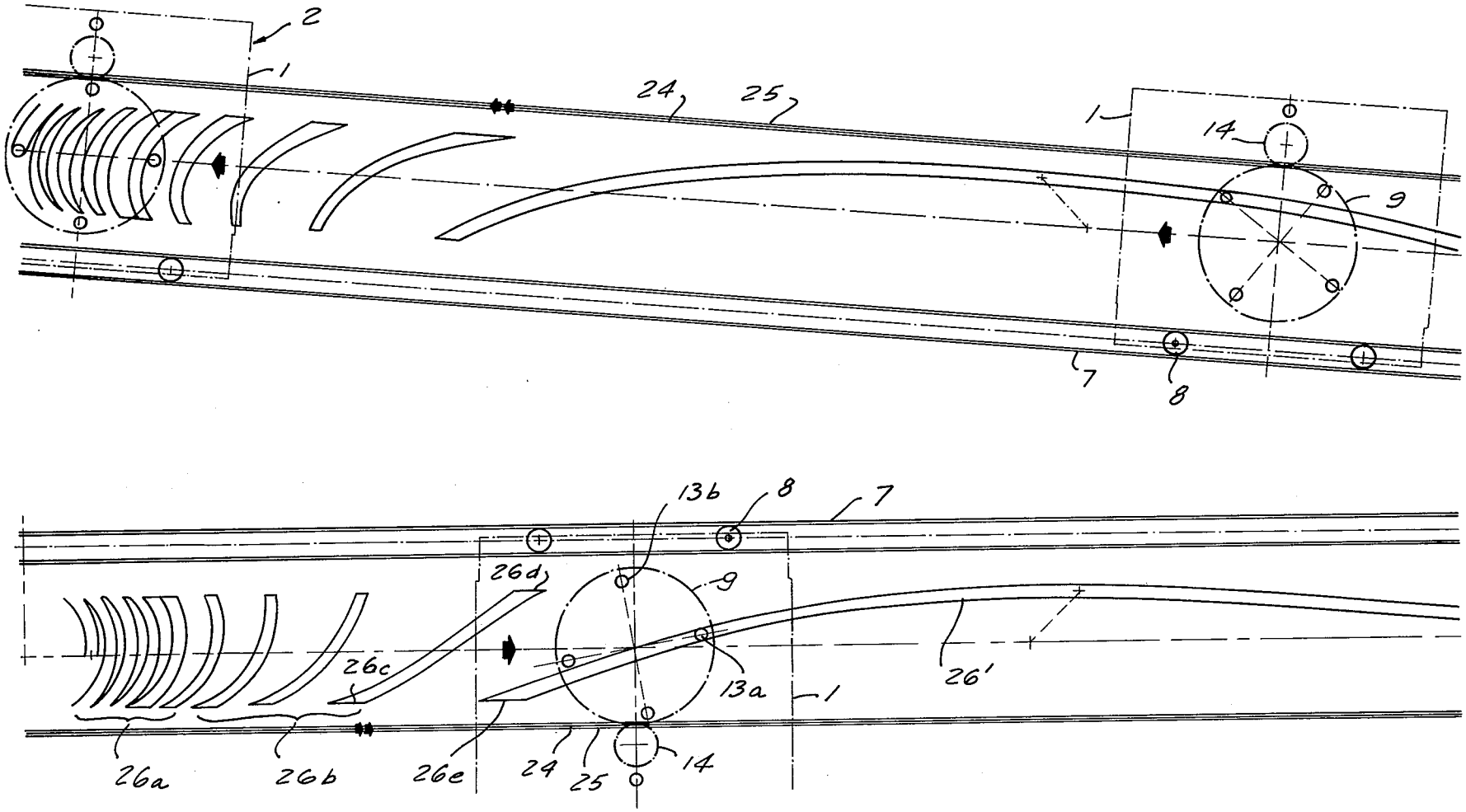
FIG. 6 is a diagrammatic plan view of two sections of track to show the acceleration and deceleration zones, respectively.

FIGS. 5 and 6 show two sections of a track for the system of the present invention, the lower segment of each section being a forward pass or stretch of the track and the upper segment being a return therefor. FIG. 5 shows an end of the track in which the two stretches are connected by a bight or curve along which incoming vehicles are shunted from the return stretch to the forward stretch. FIG. 6 shows the transition between a high speed and low speed section of the track (upper stretch) and between a low speed section and a high speed section (lower stretch).

The recirculation curve of FIG. 5 serves to deliver incoming vehicles at an end of the track to the forward stretch for advance therealong. The cable 25 and its bar 24 have a return pass at the upper part of FIG. 6 and a forward pass at the lower part of this Figure. The arrows indicate the direction of advance of the cable and of the vehicle, the latter can be identified only by their wheels 9 and pinch rollers 14, their platforms 1 and their guide rollers 8 which are received in the guide rail 7. The cam follower rollers 13 are also shown in this Figure to be angularly fixed to the wheel 9.

As has been shown in FIG. 3, only the cam follower rollers 13 which are leading (forward in the direction of advance of the vehicle) are able to engage the cam rails 26' which are fixed along the track. During the forward pass, as can be seen in FIG. 6, the cam rails 26' are of crescent configuration with a radius slightly greater than that of the arms 10 of the star wheel at whose ends are mounted the cam followers 13. The cam followers thus sweep through the channels of the cams 26' in the region **26*a* with minimum interference with the angular velocity of the wheel 9 so that the lateral advance is very small, e.g. of the order of 0.6 m/second with a linear velocity of the cable 25** of 4.5 m/second.

During the low speed movement of the platform the platform may be loaded or unloaded and passengers may embark or disembark.

Further along said stretch of the track, e.g. in the region of cams **26*b*, the crescent shape of the cam channels tends to flatten and eventually form into a substantially S shape, the S being relatively elongated so that its inclination with respect to the cable 25 passes a point of tangency before it inverts. This point of tangency corresponds to angular velocity of the wheel 9 and is followed by a negative angular velocity as has been described in connection with FIG. 1**. Consequently, the vehicle speeds up first to 4.5 m/second and then to a maximum of 7 m/second, all with a constant speed of the cable of 4.5 m/second.

Each of the cam channels 26' has an inlet or entry **26*c* and an exit 26*d* into which a cam follower roller 13*b* passes and from which the cam follower roller 13*b* emerges, respectively. The next cam follower roller 13*a* positioned to enter the mouth or entry 26*e* of the next cam formation 26' while the previous roller 13*b* is freed. As the vehicle continues along the forward pass of the track, the rollers 13** successively engage the cam formations to maintain the high speed of the vehicle.

It is preferred that the successive cam channels 26' be provided in such position that one of the cam-follower rollers 13 enters a succeeding channel while the previous cam-follower roller is still in the previous cam channel 26'.

Figure 7:
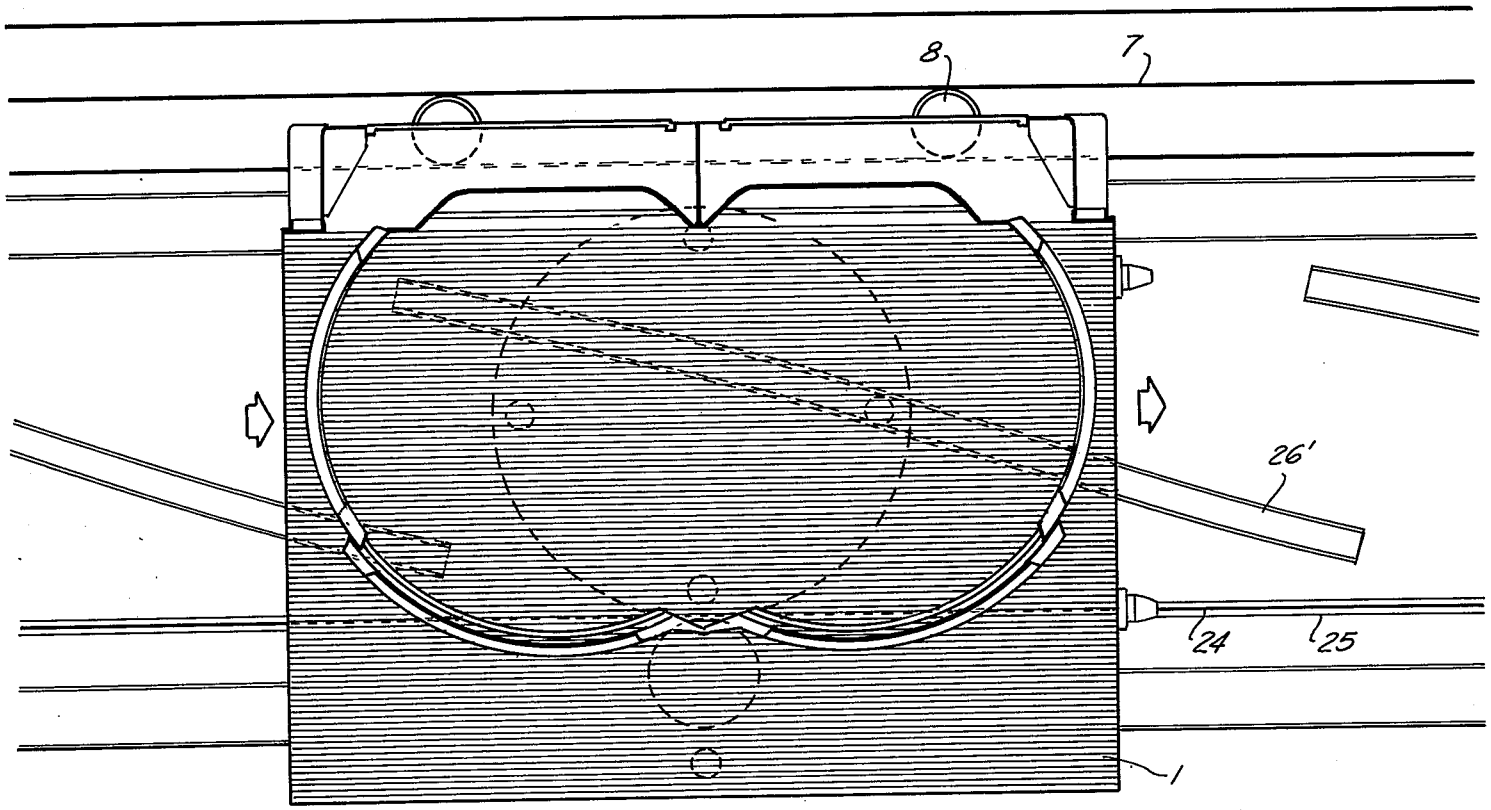
FIG. 7 is a diagrammatic view taken generally along the line VII — VII of FIG. 2 with the doors and walls of the vehicle removed, the track section being that of the highest speed.

The curvature of the rails 27 and their disposition along the track is able to be calculated in accordance with requirements by purely graphical methods or by numerical techniques. In the graphic method it is sufficient to substitute tracing members for the cam followers 13 and to entrain the cable 25 at the desired speed. All that is then necessary is to push the vehicles along at the desired programmed speed therefor. The tracing elements will give the necessary curvature of the rails 26' as a function of the speed program. This graphic method can be carried out with the aid of a model which need not generate the curvatures of the maximum speed cam channels 26' since the latter may be constant as shown in FIG. 7. The model simply serves to generate the curvatures of the acceleration and deceleration portions of the track. A trace of the cam rails 26' with a rectangular coordinate system can be obtained by ordinating.

The return stretch of the track has been illustrated at the top of FIG. 6 and the curvature of the camming rails 26'' thereof conform to the requirements of progressively decreasing vehicle speed.

FIG. 5 shown a system for transferring vehicles from the return stretch of the track to the forward stretch thereof. The principal drive mechanism formed by the cable 25 and the entrainment cam rail 26' cannot be used to advance the vehicle 2 along the bend in the track of the recycling station 27.

The mechanism for transferring the vehicles 2 from the return stretch to the forward stretch is continuously driven and comprises an endless link chain 28 driven by a motor not shown and guided in a rail 29. The chain is formed, at equispaced locations, with notched links 30 adapted to engage pins 31 carried by each platform 1. The length of the chain 28 is a multiple of the distance between pairs of the notched links 30 the spacing of which is approximately equal to the length of a platform 1. Thus the dimension of the platform along the track is equal to the spacing between the notched links 30.

At its opposite end, each platform is provided with a respective pin 31 with a spacing equal to the space between the notched links 30 and adpated to be received therein. The pins 31 are coaxial with the pairs of guide rulers 3.

As can also be seen from FIG. 5, the chain 28 progressively approaches the guide rail 7 along the return stretch of the track and hence carries a notched link 30 into engagement with the pin 31 of a vehicle 2 as the latter approaches the transfer portions of the track. The speed of the vehicles previously controlled by the cam rail 26', is thereafter regulated by and equal to the speed of the chain 28. To this end the camming rail 26' at the beginning of the transfer region and between the transfer region and the forward stretch of the track may be dimensioned and oriented to make the speed of the platform equal to that of the chain. The platforms arrive at the transfer location in closely spaced relationship and, in the event there is any slippage such that one platform approaches to other too closely, this is compensated by the spacing obtained with the notched links 30 which permits accommodation of some millimeters between the platforms.

When each platform is engaged by the chain 30, the cam follower roller 22 thereof (see FIG. 2) is brought into engagement with a rail 23 which disengages the pinch roller from the band 24 of the cable 25 and hence releases the wheel 9 from entrainment by the cable. The cable no longer controls the movement of the vehicle and the latter is displaced solely under the control of the chain 28 which plays the role of an entrainment relay operating at minimum speed.

After the cable 25 is released from the vehicle, the cable passes around a pulley 32 having a horizontal axis and then passes downwardly at a certain inclination to form a loop around another pulley 33 disposed below the track and lying in a plane substantially tangent to the pulley 32. The cable is formed into a second loop around another pulley 34 having a vertical axis and urged by a traction spring (not shown) and a connecting rod 35 to the right (FIG. 5) to maintain the cable tension. Pulleys 32, 33, 34, 36 and 37 all may be idlers.

The spring may be adjustable to regulate the tension in cable 25. The cable then passes around a third loop and a pulley 36 lying in the same plane as pulley 33 before it rises to pass over a pulley 37 having a horizontal axis. The pulley 36 can lie in a plane inclined downwardly but tangent to pulley 37. This arrangement of pulleys deflects the cable away from the track and out of the path of the vehicle at the return side of the track and then back up to the level of the vehicles in the forward side of the track.

The disengagement cam 23 acts against the cam follower roller 22 carried by lever 17 which is thereby swung in the counterclockwise sense (FIG. 2) to swing bar 15 in the clockwise sense and free the cable 25. The pulleys 36 and 37 are disposed such that they lead the cable progressively upwardly to insert the bar 24 between the spread-apart wheels 9 and 14 so that, when the vehicle is moved past the cam 23, roller 22 is released and wheel 14 pinches the bar 24 against wheel 9.

On the return side of the track, the cam 23 engages the cam follower roller 22 to release the cable 25 from wheel 9. Upon such release, the cam follower rollers 13 engage their successive entrainment rails 26' with concavities turned toward the center of the wheel 9. These last three rails therefore do not act for displacement of the vehicle but as braking rails to temporarily immobilize wheel 9 angularly and lead a cam follower roller 13 into a rail 26' forming a channel parallel to the curve 27 of the transfer section of the track.

The vehicle 2 is thus disengaged from cable 25 at the instant its pin 31 is received in the notched link 30. At this point the chain is entrained in the same sense of advance of vehicles 2 and cable 25 indicated by the arrows.

Thus, while wheel 9 is immobilized at the instant it is released from the cable, it is in a position to start again in the sense of advance when the vehicle reaches the forward stretch of track in the region of pulley 37.

The release takes place at the moment at which the wheel 9 has attained an angular velocity for which there can be no slip between cable 25 and wheel 9. This speed is a function of the linear rail speed of the cable and the vehicle. The entrainment rails 26' which follow the disengagement shown and disposed after pulley 37 is of such configuration to entrain the vehicle at a minimum constant speed which corresponds, in the present case, to 0.6 m/second. The vehicles are entrained at this speed by the chain 28 along the recycling section of the track. Since all of the vehicles in the recycling section are engaged by the chain 28 and are displaced for the minimum speed, they are fixedly positioned with respect to one another. As long as the vehicles are moved by the chain along a rectilinear portion of the track, they lie one adjacent to the other. However, when they pass around the curve 27 of the recycling section, the lateral edges of neighboring vehicles spread apart by virtue of the fact that the axes of the rollers 8 guided in channel 7 coincide substantially with the longitudinal edges of the platform 1 turned toward the interior of the curve 27.

Since the platform is articulated relative to the tract about the axis of the pairs of rollers 8, the points of intersection of the two transverse boundaries of the platform perpendicular to its longitudinal boundaries, which is turned toward the interior of the curve 27, coincides with the respective points of tangency of these two transverse boundaries with two circles centered respectively on the axis of the two pairs of guide rollers 8. As a consequence, the points of tangency are spread toward the exterior and shift along the respective circles mentioned above so that the sides of adjacent vehicles separate progressively.

Conversely, when the platforms of vehicles make the transition from the curve 27 to the rectilinear track portion at the forward stretch, the sides of successive platforms approach one another until the platforms become mutually adjacent once again.

The transport system described and especially the entrainment arrangement for varying the vehicle speed at different locations along the track has the important advantage that the entire system can be driven by a single engine or motor with speeds programmed for the vehicle as a function of location along the track. Synchronization is not a problem since it is inherent in the relationship of each vehicle to the entrainment rails 26'. Finally, the drive element can operate at a constant speed at all times.

It is important to recall that slippage between the cable 25 and each wheel 9 must be completely eliminated or avoided. As a consequence the band 24 can be fluted or channeled, the lever 17 must be absolutely rigid and there should be no play in the means for applying pressure to the pinch roller 14. The distance between the pivot center 18 of the lever and the axis of wheel 9 determines the grip upon the band 24 and it is important that the parts of the pressure device illustrated in FIG. 2 be dimensioned to maintain the minimum gripping pressure. The minimum gripping force must be that which will prevent slippage at the maximum tractive force applied between the vehicle and the cable at maximum speed of the vehicle. The restarting of the apparatus is no problem since the vehicles do not pass dead points and it is simply a matter of progressively increasing the cable speed to start up the system from a standstill.

I claim:

1. A vehicle installation comprising:

a track formed with rolling and guiding rails;

at least one vehicle displaced along said track and provided with roller means engaging said rails and having axes lying in a first plane;

a cable displaceable along said track at a predetermined speed;

a wheel journaled on said vehicle and having a periphery engageable with said cable, and a pinching roller journaled on said vehicle for clamping against the periphery of said wheel, said pinching roller and said wheel having axes lying in a second plane to said first plane;

actuating means on said vehicle for urging said pinching roller toward the periphery of said wheel;

a mobile body having a plurality of angularly spaced arms rotatable on said vehicle and angularly entrained with said wheel, said body and said wheel having coplanar axes, said arms being formed in a plane substantially perpendicular to the axis of said body; and entrainment cams engageable by said arms and fixed relative to said track at spaced locations therealong, said cams being positioned for engagement with said arms to thereby constrain the angular displacement of said wheel and selectively, in accordance with the configuration and position of said cam, enable the entrainment of said vehicle by said cable at a velocity in excess of that of said cable, at a velocity less than that of said cable and at the same velocity as said cable.

2. The installation defined in claim 1 wherein said arms are formed with cam follower rollers lying in a plane inclined downwardly, said cams being engageable with said rollers at the low point in the trajectory of said arms.

3. The installation defined in claim 2 wherein said acutating means includes a bar swingably mounting said pinch roller on said vehicle, a lever connected to said bar and fulcrumed on said vehicle, a cam rail positioned along said track and a cam follower roller on said lever engageable with said cam relative to disengaging said cable from between said wheel and said pinch roller.

4. The installation defined in claim 1 wherein said cable is formed with a fluted band engageable between said pinch roller and said wheel.

5. The installation defined in claim 4 wherein said wheel is formed with an elastic periphery having a high coefficient of friction.

6. The installation defined in claim 1 wherein said track has a forward stretch and a return stretch and a curve between said stretches, said cams at the junction between said return stretch and said curve being shaped to reduce the speed of a vehicle passing from said return stretch to said curve, and said cams at the junction between said curve and said forward stretch being dimensioned and positioned to increase the speed of a vehicle passing from said curve to said forward stretch, said installation further comprising a relay drive and entraining said vehicle along said curve.

7. The installation defined in claim 7 wherein a respective cam rail is disposed at each of said junctions for engagement with the actuating means to displace said pinch roller away from said wheel.

8. The installation defined in claim 7 wherein the relay drive is an endless chain provided with formations engageable in successive vehicles for leading same around said curve.

* * * * *